US009097444B2

(12) United States Patent
Lee et al.

(10) Patent No.: US 9,097,444 B2
(45) Date of Patent: Aug. 4, 2015

(54) HEAT PUMP TYPE WATER HEATING APPARATUS

(75) Inventors: Donghyuk Lee, Changwon-si (KR); Jongchul Ha, Changwon-si (KR)

(73) Assignee: LG Electronics Inc., Seoul (KR)

( * ) Notice: Subject to any disclaimer, the term of this patent is extended or adjusted under 35 U.S.C. 154(b) by 905 days.

(21) Appl. No.: 13/163,393

(22) Filed: Jun. 17, 2011

(65) Prior Publication Data

US 2012/0102991 A1 May 3, 2012

(30) Foreign Application Priority Data

Nov. 1, 2010 (KR) ..... 10-2010-0107805

(51) Int. Cl.
*F25B 7/00* (2006.01)
*F25B 13/00* (2006.01)
*F25B 25/00* (2006.01)

(52) U.S. Cl.
CPC . *F25B 13/00* (2013.01); *F25B 7/00* (2013.01); *F25B 25/005* (2013.01); *F25B 2313/003* (2013.01)

(58) Field of Classification Search
CPC ..... F25B 13/00; F25B 41/046; F25B 7/00; F25B 29/00; F25B 2313/003; F25B 29/003; Y02B 30/12; Y02B 30/123; Y02B 30/18
USPC ..... 62/238.7, 333, 335, 324.6, 159, 238.1, 62/238.6, 90, 325
See application file for complete search history.

(56) References Cited

U.S. PATENT DOCUMENTS 3,564,865 A 2/1971 Spencer ..... 62/197
4,594,858 A 6/1986 Shaw
5,161,386 A 11/1992 Higuchi (Continued)

FOREIGN PATENT DOCUMENTS

CN 101163925 4/2008
EP 2244037 10/2010

(Continued)

OTHER PUBLICATIONS

U.S. Office Action dated Jul. 10, 2013, issued in U.S. Appl. No. 13/163,420.

(Continued)

*Primary Examiner* — Frantz Jules
*Assistant Examiner* — Meraj A Shaikh
(74) *Attorney, Agent, or Firm* — KED Associates LLP

(57) ABSTRACT

A heat pump type water heating apparatus is provided that includes a refrigeration cycle circuit having a first refrigerant and water heat exchanger to perform a heat exchange between a first refrigerant and water, and a first refrigerant and second refrigerant heat exchanger to perform a heat exchange between the first refrigerant and a second refrigerant. The heat pump type water heating apparatus may also include a cascade circuit having the first refrigerant and second refrigerant heat exchanger to operate jointly with the refrigeration cycle circuit, the cascade circuit also having a second refrigerant and water heat exchanger to perform a heat exchange between the second refrigerant and water, and a water heating channel connected to the first refrigerant and water heat exchanger and the second refrigerant and water heat exchanger so water passes through the first refrigerant and water heat exchanger and then through the second refrigerant and water heat exchanger.

13 Claims, 7 Drawing Sheets

(56) References Cited

U.S. PATENT DOCUMENTS

| | | | | |
|---|---|---|---|---|
| 6,293,123 | B1 | 9/2001 | Iritani et al. | |
| 6,829,903 | B2 | 12/2004 | Lee et al. | |
| 8,074,459 | B2 * | 12/2011 | Murakami et al. | 62/159 |
| RE43,121 | E * | 1/2012 | Peterson | 62/196.1 |
| 8,181,470 | B2 * | 5/2012 | Narayanamurthy et al. | 62/113 |
| 8,640,475 | B2 * | 2/2014 | Park et al. | 62/238.7 |
| 2004/0118135 | A1 * | 6/2004 | Lee et al. | 62/175 |
| 2004/0144528 | A1 | 7/2004 | Kunimoto et al. | |
| 2007/0012053 | A1 | 1/2007 | Eisenhower et al. | |
| 2007/0017240 | A1 | 1/2007 | Shapiro et al. | |
| 2009/0049855 | A1 | 2/2009 | Murata et al. | |
| 2010/0025488 | A1 * | 2/2010 | Park et al. | 237/2 B |
| 2010/0050675 | A1 * | 3/2010 | Kameyama et al. | 62/238.7 |
| 2010/0243202 | A1 | 9/2010 | Han et al. | |
| 2010/0282434 | A1 | 11/2010 | Yabuuchi et al. | |
| 2010/0282435 | A1 | 11/2010 | Yabuuchi et al. | |
| 2010/0326107 | A1 | 12/2010 | Honma et al. | |
| 2011/0016897 | A1 | 1/2011 | Akagi et al. | |
| 2011/0113808 | A1 | 5/2011 | Ko et al. | |
| 2011/0283725 | A1 * | 11/2011 | Sim | 62/151 |
| 2011/0283726 | A1 * | 11/2011 | Sim | 62/160 |
| 2011/0289952 | A1 * | 12/2011 | Kim et al. | 62/189 |
| 2011/0314848 | A1 | 12/2011 | Tanaka et al. | |
| 2012/0042678 | A1 * | 2/2012 | Park et al. | 62/324.1 |
| 2012/0060551 | A1 * | 3/2012 | Takayama et al. | 62/513 |
| 2012/0111032 | A1 * | 5/2012 | Woo et al. | 62/79 |
| 2012/0111050 | A1 * | 5/2012 | Jang et al. | 62/510 |
| 2012/0222440 | A1 * | 9/2012 | Matsui et al. | 62/159 |
| 2012/0285188 | A1 * | 11/2012 | Honda | 62/160 |
| 2012/0297806 | A1 * | 11/2012 | Honda | 62/222 |
| 2013/0227979 | A1 * | 9/2013 | Kasuka et al. | 62/175 |
| 2013/0269379 | A1 * | 10/2013 | Ue et al. | 62/160 |

FOREIGN PATENT DOCUMENTS

| | | | |
|---|---|---|---|
| JP | 01256762 | A * | 10/1989 |
| JP | 04-254156 | A | 9/1992 |
| JP | 04263758 | A * | 9/1992 |
| JP | 2001-074319 | | 3/2001 |
| JP | 2005-061784 | | 3/2005 |
| JP | 2006-200888 | | 8/2006 |
| JP | 2007-093043 | | 4/2007 |
| KR | 10-1988-0004283 | | 6/1988 |
| KR | 10-2006-0098263 | | 9/2006 |
| KR | 10-2006-0100795 | | 9/2006 |
| KR | 10-2008-0097511 | | 11/2008 |
| WO | WO 2010/113372 | | 7/2010 |
| WO | WO 2010/098005 | A1 | 9/2010 |
| WO | WO 2010098607 | A2 * | 9/2010 |

OTHER PUBLICATIONS

U.S. Office Action dated Jul. 2, 2013, issued in U.S. Appl. No. 13/163,441.

Office Action dated Oct. 30, 2013 for U.S. Appl. No. 13/163,441.

U.S. Office Action issued in co-pending U.S. Appl. No. 13/163,420 dated Aug. 27, 2014.

U.S. Office Action for U.S. Appl. No. 13/163,420 dated Jan. 22, 2014.

Chinese Office Action for Application 201110072621.7 dated Dec. 9, 2013.

European Search Report issued in application No. 11164616.2 dated Dec. 12, 2014.

* cited by examiner

HEAT PUMP TYPE WATER HEATING APPARATUS

CROSS-REFERENCE TO RELATED APPLICATION

This application claims priority benefit from Korean Patent Application No. 10-2010-0107805, filed Nov. 1, 2010, the subject matter of which is incorporated herein by reference.

BACKGROUND

1. Field

Embodiments of the present invention may relate to a heat pump type water heating apparatus that heats water using a refrigerant.

2. Background

A heat pump is an air conditioner that transmits a low-temperature heat source to a high temperature zone and/or that transmits a high-temperature heat source to a low temperature zone using exothermic and endothermic reactions of a refrigerant.

The heat pump may include a compressor, a condenser, an expansion device, and an evaporator. A heat pump type water heating apparatus may heat water using a refrigerant so as to supply hot water, thereby minimizing consumption of fossil fuel.

The heat pump type water heating apparatus may include a compressor to compress a refrigerant, a refrigerant and water heat exchanger to heat water using the refrigerant compressed by the compressor, an expansion device to expand the refrigerant having passed through the refrigerant and water heat exchanger, and an evaporator to evaporate the refrigerant expanded by the expansion device.

In the heat pump type water heating apparatus, the refrigerant compressed by the single compressor may heat water in a single refrigerant and water heat exchanger so the water heated by the refrigerant and water heat exchanger may be used. As a result, increasing the water heating temperature may be limited, and optimum control based on a water temperature may not be easy.

BRIEF DESCRIPTION OF THE DRAWINGS

Arrangements and embodiments may be described in detail with reference to the following drawings in which like reference numerals refer to like elements and wherein.

DETAILED DESCRIPTION

Exemplary embodiments may be described with reference to the attached drawings.

Figure 1:
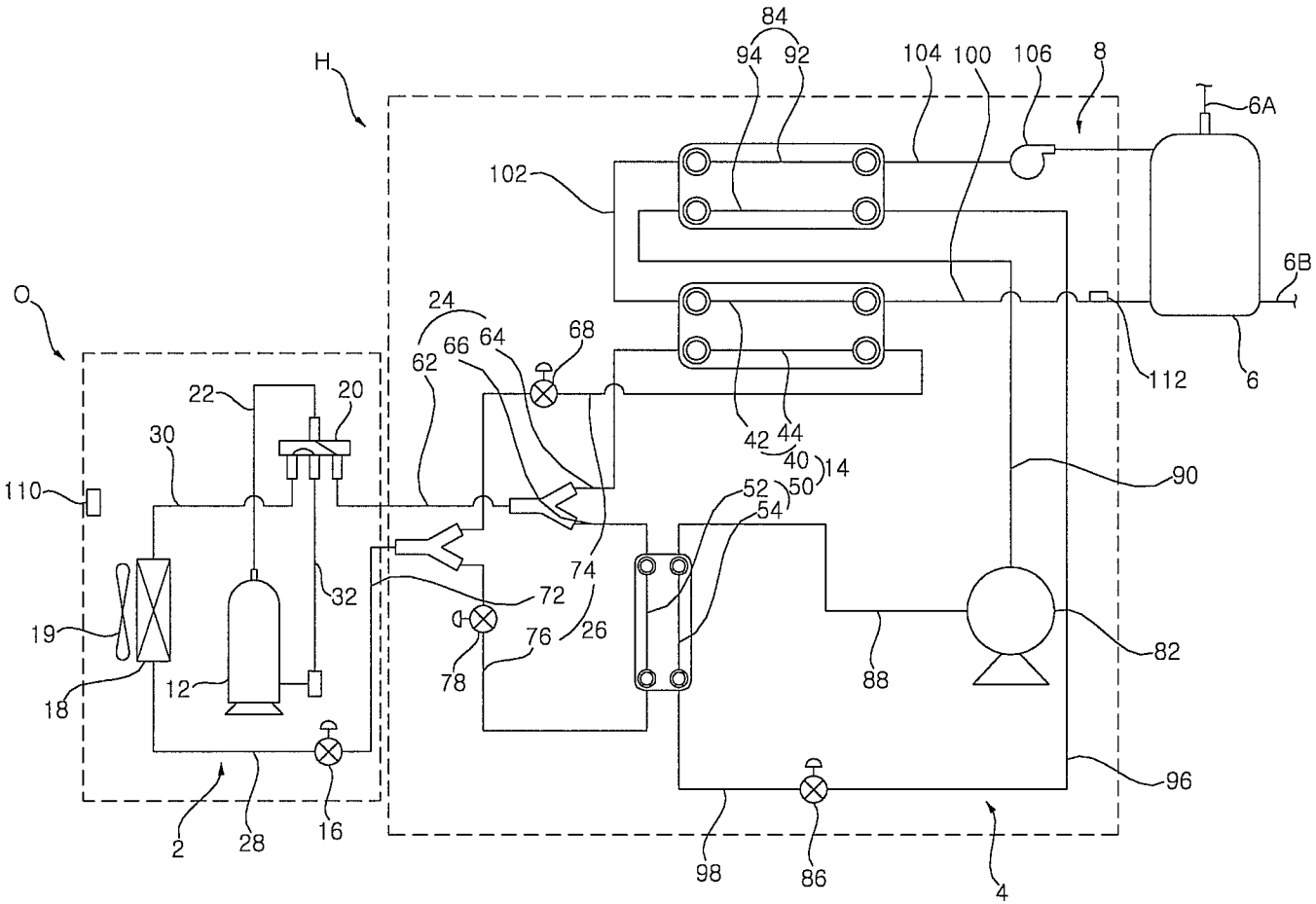
FIG. 1 is a view of a heat pump type water heating apparatus according to an embodiment of the present invention.
Figure 2:
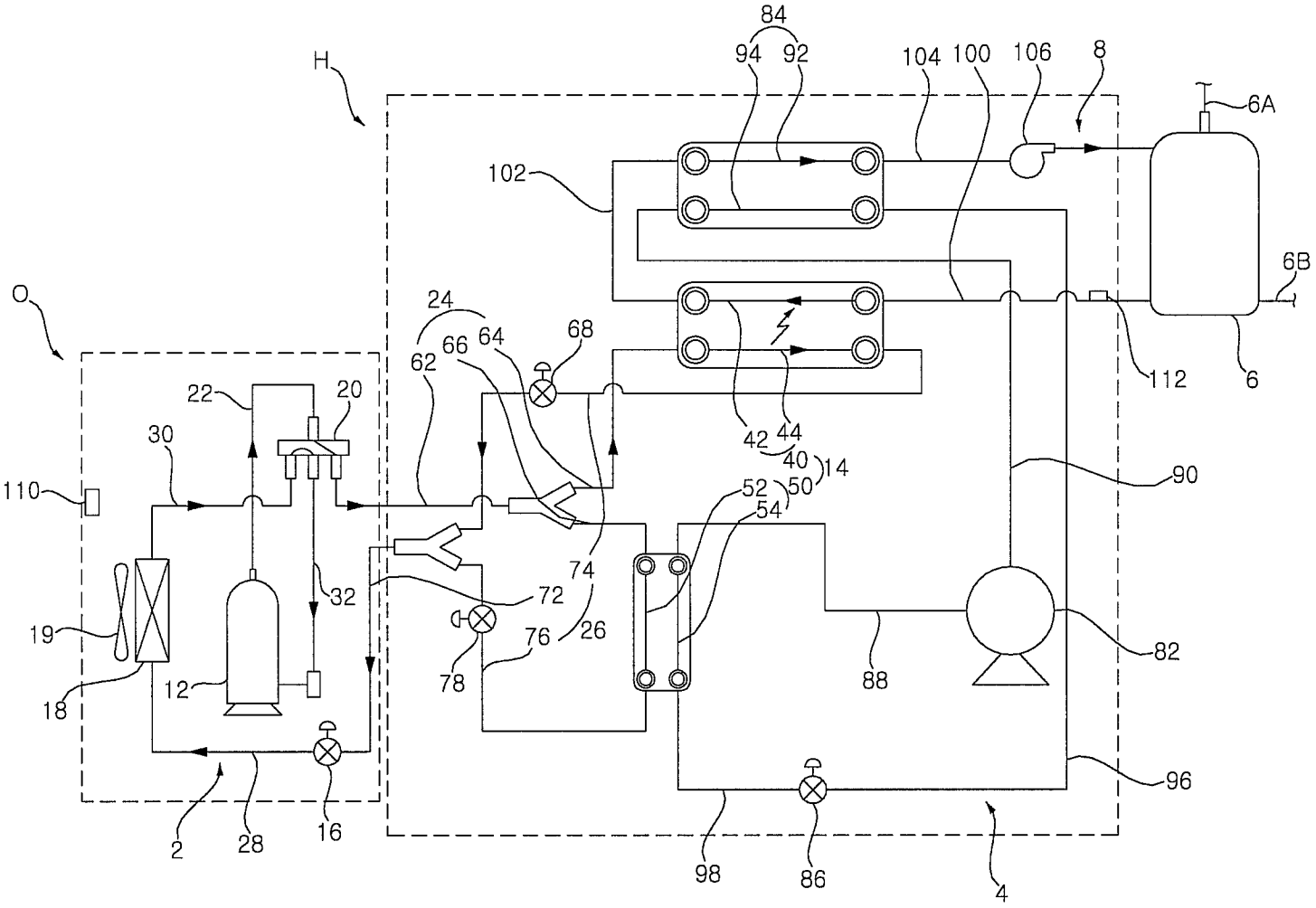
FIG. 2 is a view of a heat pump type water heating apparatus illustrating flow of a refrigerant and water during heating of water in a single heating mode.
Figure 3:
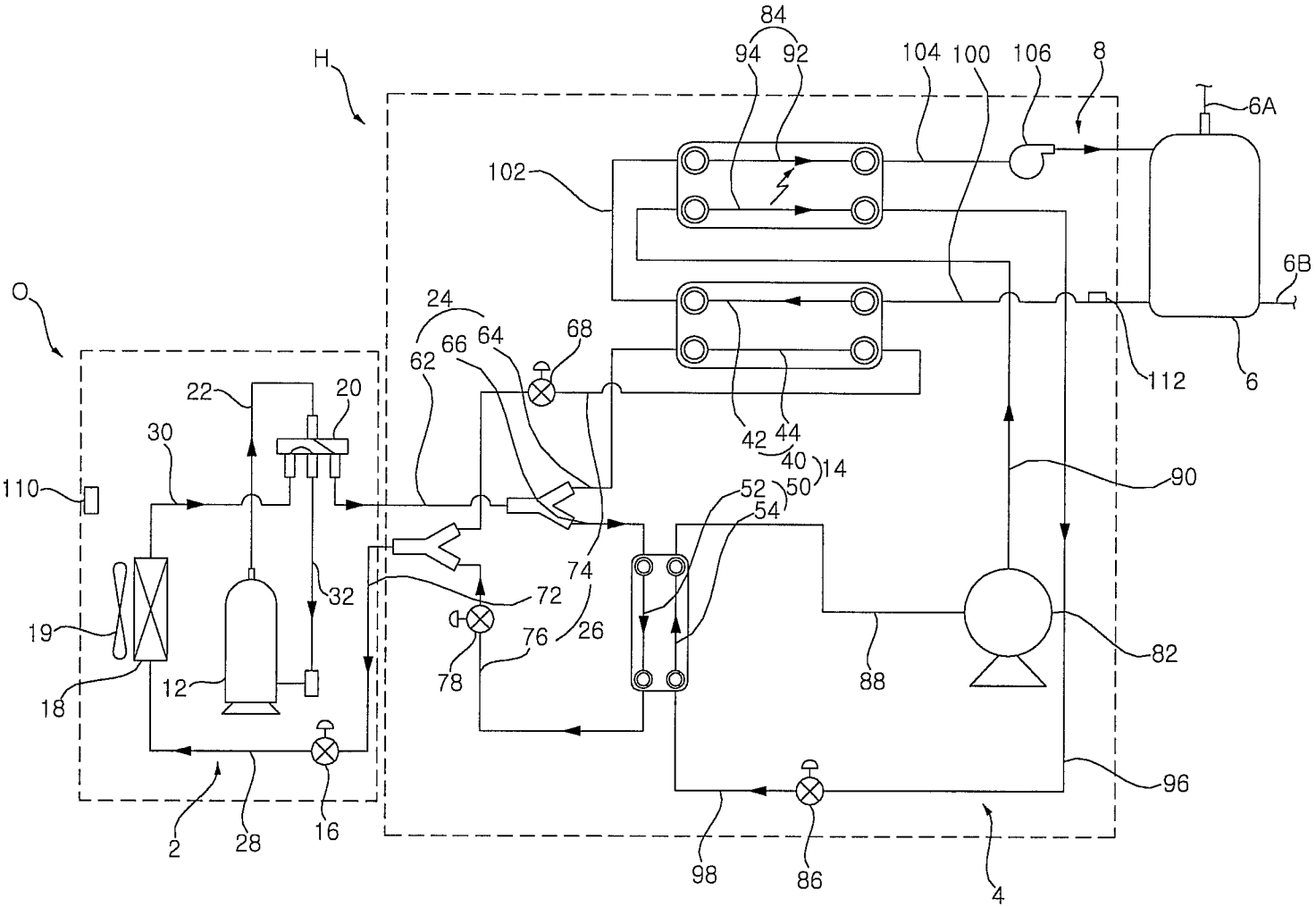
FIG. 3 is a view of a heat pump type water heating apparatus illustrating flow of a refrigerant and water during heating of water in a reheating mode.
Figure 4:
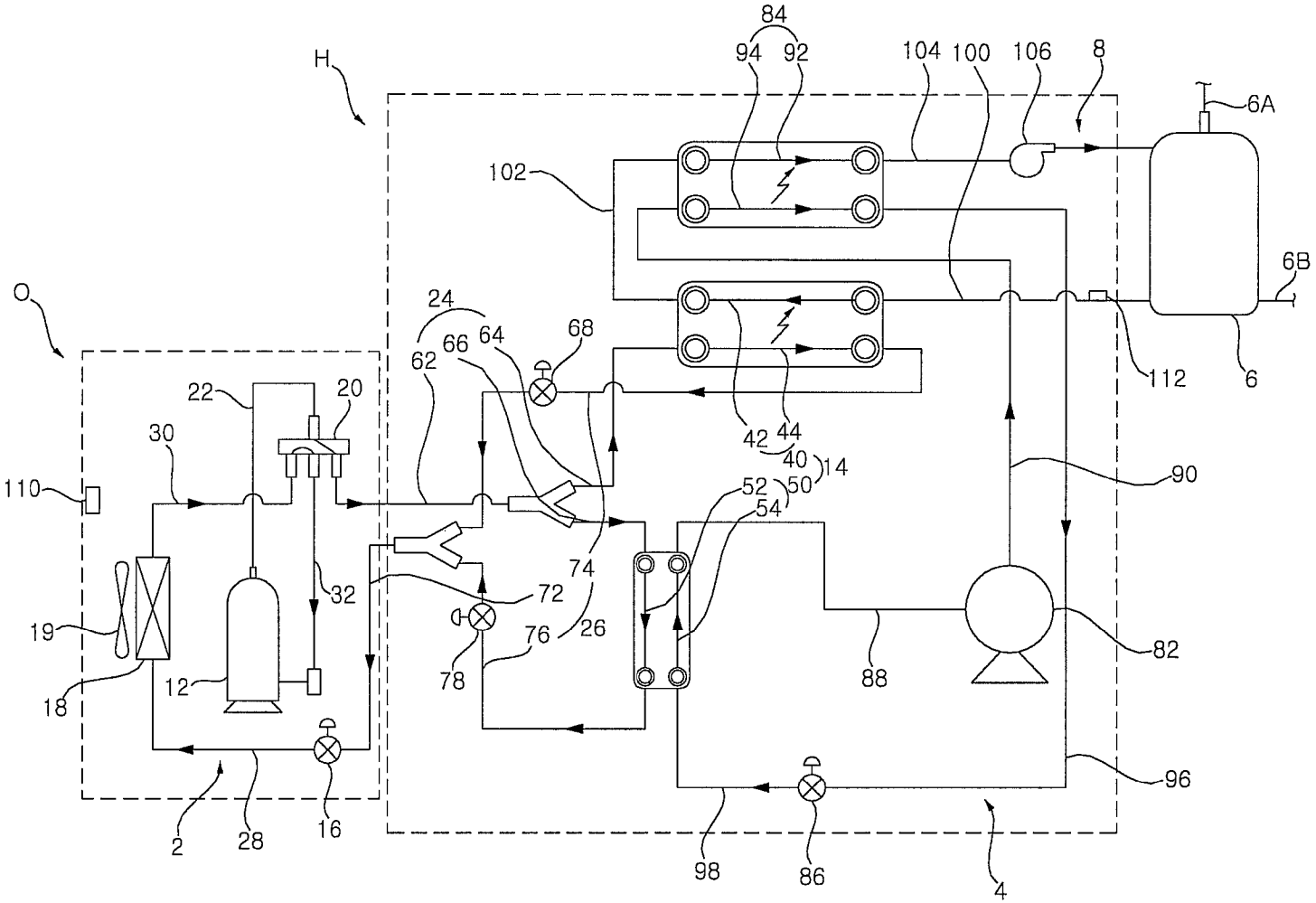
FIG. 4 is a view of a heat pump type water heating apparatus illustrating flow of a refrigerant and water during heating of water in a multistage heating mode.
Figure 5:
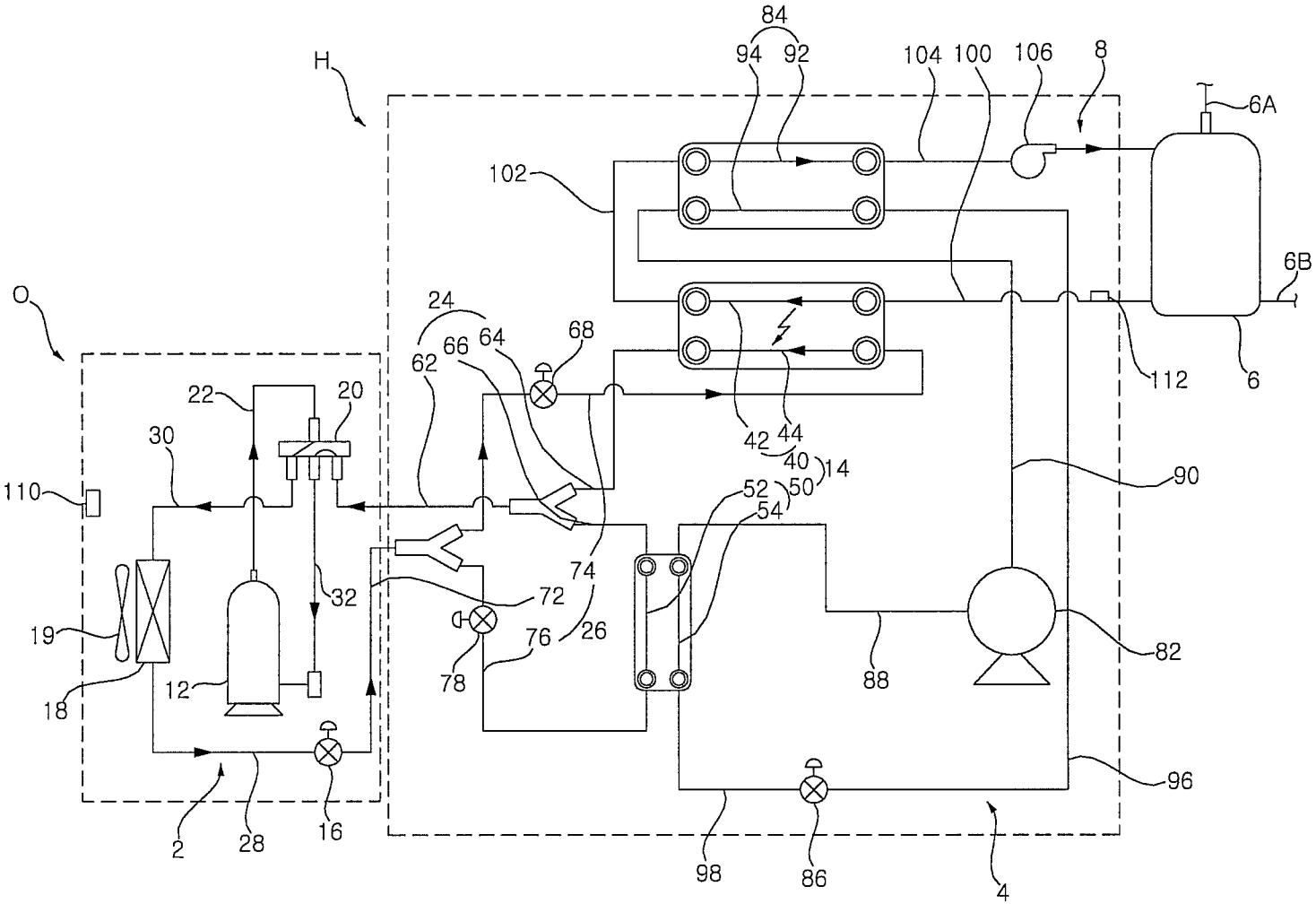
FIG. 5 is a view of a heat pump type water heating apparatus illustrating flow of a refrigerant and water during cooling of water in a cooling mode.

FIG. 1 is a view of a heat pump type water heating apparatus according to an embodiment of the present invention. FIG. 2 is a view of a heat pump type water heating apparatus illustrating flow of a refrigerant and water during heating of water in a single heating mode. FIG. 3 is a view of a heat pump type water heating apparatus illustrating flow of a refrigerant and water during heating of water in a reheating mode. FIG. 4 is a view of a heat pump type water heating apparatus illustrating flow of a refrigerant and water during heating of water in a multistage heating mode. FIG. 5 is a view of a heat pump type water heating apparatus illustrating flow of a refrigerant and water during cooling of water in a cooling mode. Other embodiments and configurations may also be provided.

As shown in FIGS. 1 to 5, the heat pump type water heating apparatus includes a refrigeration cycle circuit 2 (or refrigeration cycle part) to heat water using a first refrigerant and, at a same time, to evaporate a second refrigerant, a cascade circuit 4 (or cascade part) to heat water using the second refrigerant evaporated by the refrigeration cycle circuit 2, and a water heating channel 8 connected between the refrigeration cycle circuit 2 and the cascade circuit 4 to heat water using heat generated from the first refrigerant and heat generated from the second refrigerant.

The refrigeration cycle circuit 2 may form a low temperature refrigeration cycle. The cascade circuit 4 may form a high temperature refrigeration cycle that performs a heat exchange with the low temperature refrigeration cycle. The first refrigerant and the second refrigerant may have different condensation temperatures and different evaporation temperatures. R410A, which has a low condensation temperature and a low evaporation temperature and that exhibits a high efficiency at a relatively low temperature area, may be used as the first refrigerant. R134a, which has a higher condensation temperature and a higher evaporation temperature than the first refrigerant and that exhibits a high efficiency at a relatively high temperature area, may be used as the second refrigerant.

The refrigeration cycle circuit 2 may include a compressor 12, a dual heat exchanger 14, an expansion device 16, and an outdoor heat exchanger 18, via which the first refrigerant is circulated.

The compressor 12 may be a constant-speed compressor or a variable capacity compressor. Alternatively, the compressor 12 may include a plurality of constant-speed compressors connected in parallel to each other or a plurality of variable capacity compressors connected in parallel to each other. The compressor 12 may also include a constant-speed compressor and a variable capacity compressor connected in parallel to each other.

The dual heat exchanger 14 may include a first refrigerant and water heat exchanger 40 to perform a heat exchange between the first refrigerant and water, and a first refrigerant and second refrigerant heat exchanger 50 to perform a heat exchange between the first refrigerant and the second refrigerant. The first refrigerant and water heat exchanger 40 and the first refrigerant and second refrigerant heat exchanger 50 may be described below.

The expansion device 16 may be provided between the dual heat exchanger 14 and the outdoor heat exchanger 18 to expand the first refrigerant condensed by the dual heat exchanger 14. The expansion device 16 may be a linear expansion valve (LEV) or an electronic expansion valve (EEV) in which an opening degree is variable.

The outdoor heat exchanger 18 may be provided between the expansion device 16 and the compressor 12 to evaporate the first refrigerant expanded by the expansion device 16. The heat pump type water heating apparatus may further include an outdoor fan 19 to supply outdoor air to the outdoor heat exchanger 18. The outdoor fan 19 may rotate, upon operation of the compressor 12, to supply outdoor air to the outdoor heat exchanger 18.

The refrigeration cycle circuit 2 may further include a mode switching valve 20 to adjust a flow direction of the first refrigerant. The mode switching valve 20 may enable the first refrigerant to circulate in order via the compressor 12, the dual heat exchanger 14, the expansion device 16, and the outdoor heat exchanger 18. Alternatively, the mode switching valve 20 may enable the first refrigerant to circulate in order via the compressor 12, the outdoor heat exchanger 18, the expansion device 16, and the dual heat exchanger 14.

In at least one embodiment, the refrigeration cycle circuit 2 may not include the mode switching valve 20. The refrigeration cycle circuit 2 may also include the mode switching valve 20 to remove frost from the outdoor heat exchanger 18 or to cool water.

The mode switching valve 20 may perform a switching operation between a water heating mode and a water cooling mode (or a frosting removal mode that may hereinafter be referred to as a water cooling mode). In the water heating mode, the mode switching valve 20 operates so the first refrigerant is circulated in order via the compressor 12, the dual heat exchanger 14, the expansion device 16, and the outdoor heat exchanger 18. In the water cooling mode, the mode switching valve 20 operates so the first refrigerant is circulated in order via the compressor 12, the outdoor heat exchanger 18, the expansion device 16, and the dual heat exchanger 14. In the following description, the refrigeration cycle circuit 2 includes the mode switching valve 20.

The compressor 12 and the mode switching valve 20 may be connected to each other via a refrigerant flow channel 22 (i.e., a compressor outlet channel). The mode switching valve 20 and the dual heat exchanger 14 may be connected to each other via a refrigerant flow channel 24 (i.e., a mode switching valve and dual heat exchanger connection channel). The dual heat exchanger 14 and the expansion device 16 may be connected to each other via a refrigerant flow channel 26 (i.e., a dual heat exchanger and expansion device connection channel). The expansion device 16 and the outdoor heat exchanger 18 may be connected to each other via a refrigerant flow channel 28 (i.e., an expansion device and outdoor heat exchanger connection channel). The outdoor heat exchanger 18 and the mode switching valve 20 may be connected to each other via a refrigerant flow channel 30 (i.e., an outdoor heat exchanger and mode switching valve connection channel). The mode switching valve 20 and the compressor 12 may be connected to each other via a refrigerant flow channel 32 (i.e., a compressor inlet channel).

The dual heat exchanger 14 may now be described.

The first refrigerant and water heat exchanger 40 may function as a first water heating heat exchanger to primarily heat water that passes therethrough. The first refrigerant and second refrigerant heat exchanger 50 may function as a cascade heat exchanger to perform a heat exchange between the first refrigerant and the second refrigerant.

The first refrigerant and water heat exchanger 40 may include a heat absorption channel 42, through which water passes, and a heat discharge channel 44, in which the first refrigerant that passes therethrough is heat exchanged with water. The first refrigerant and water heat exchanger 40 may be a plate type heat exchanger having heat absorption channel portions constituting the heat absorption channel 42 and heat discharge channel portions constituting the heat discharge channel 44 alternately arranged while heat transfer members are provided respectively between the heat absorption channel portions constituting the heat absorption channel 42 and the heat discharge channel portions constituting the heat discharge channel 44. Alternatively, the first refrigerant and water heat exchanger 40 may be a dual pipe heat exchanger configured so the heat absorption channel 42 or the heat discharge channel 44 surrounds the heat discharge channel 44 or the heat absorption channel 42. The first refrigerant and water heat exchanger 40 may be a shell and tube heat exchanger having a shell, through which the first refrigerant or water passes, and a plurality of tubes provided in the shell so the water or the first refrigerant passes through the tubes.

The first refrigerant and second refrigerant heat exchanger 50 may include a condensation channel 52 to condense the first refrigerant that passes therethrough and an evaporation channel 54 to evaporate the second refrigerant that passes therethrough. The first refrigerant and second refrigerant heat exchanger 50 may be a plate type heat exchanger having condensation channel portions constituting the condensation channel 52 and evaporation channel portions constituting the evaporation channel 54 alternately arranged while heat transfer members are provided respectively between the condensation channel portions constituting the condensation channel 52 and the evaporation channel portions constituting the evaporation channel 54. Alternatively, the first refrigerant and second refrigerant heat exchanger 50 may be a dual pipe heat exchanger configured so the condensation channel 52 or the evaporation channel 54 surround the evaporation channel 54 or the condensation channel 52. The first refrigerant and second refrigerant heat exchanger 50 may also be a shell and tube heat exchanger having a shell, through which the first refrigerant or the second refrigerant passes, and a plurality of tubes provided in the shell so the second refrigerant or the first refrigerant passes through the tubes.

The first refrigerant and water heat exchanger 40 and the first refrigerant and second refrigerant heat exchanger 50 may be arranged so the refrigerant flow channels 24 and 26 are connected in parallel to each other.

The refrigerant flow channel 24 between the mode switching valve 20 and the dual heat exchanger 14 may include a first common flow channel 62 connected to the mode switching valve 20, a first branch flow channel 64 connected between the first common flow channel 62 and the first refrigerant and water heat exchanger 40, and a second branch flow channel 66 connected between the first common flow channel 62 and the first refrigerant and second refrigerant heat exchanger 50.

The refrigerant flow channel 26 between the dual heat exchanger 14 and the expansion device 16 may include a second common flow channel 72 connected to the expansion device 16, a third branch flow channel 74 connected between the second common flow channel 72 and the first refrigerant and water heat exchanger 40, and a fourth branch flow channel 76 connected between the second common flow channel 72 and the first refrigerant and second refrigerant heat exchanger 50.

The heat pump type water heating apparatus may further include a first control valve 68 to control flow of the first refrigerant to the first refrigerant and water heat exchanger 40, and a second control valve 78 to control flow of the first refrigerant to the first refrigerant and second refrigerant heat exchanger 50.

The first control valve 68 may be provided at the first branch flow channel 64 or at the third branch flow channel 74. The first control valve 68 may be an electronic opening and closing valve configured to be turned on and off. Alternatively, the first control valve 68 may be a linear expansion valve (LEV) or an electronic expansion valve (EEV) in which an opening degree is variable.

The second control valve 78 may be provided at the second branch flow channel 66 or at the fourth branch flow channel 76. The second control valve 78 may be an electronic opening and closing valve configured to be turned on and off. Alternatively, the second control valve 78 may be a linear expansion valve (LEV) or an electronic expansion valve (EEV) in which an opening degree is variable.

In an example in which the first control valve 68 and the second control valve 78 are linear expansion valves or electronic expansion valves, the first control valve 68 and the second control valve 78 may expand the first refrigerant to adjust a supercooling degree of the first refrigerant. Additionally, the first control valve 68 and the second control valve 78 may substitute for the expansion device 16. That is, in an example in which the first control valve 68 is provided on the third branch flow channel 74 and the second control valve 78 is provided on the fourth branch flow channel 78, the first refrigerant may be condensed by the first refrigerant and water heat exchanger 40, or the first refrigerant and second refrigerant heat exchanger 50 may be expanded by the first control valve 68 or the second control valve 78. The supercooling degree of the first refrigerant may be adjusted by controlling an opening degree of the first control valve 68.

The refrigeration cycle circuit 2 may include a three way valve to control flow of the first refrigerant to the first refrigerant and water heat exchanger 40 and to the first refrigerant and second refrigerant heat exchanger 50. The three way control valve may be used rather than (or in place of) the first control valve 68 and the second control valve 78.

In the water heating mode, the refrigeration cycle circuit 2 may operate as follows. The first refrigerant, compressed by the compressor 12, may be condensed by the first refrigerant and water heat exchanger 40 or the first refrigerant and second refrigerant heat exchanger 50. The condensed refrigerant may be expanded by the expansion device 16. The expanded refrigerant may be evaporated by the outdoor heat exchanger 18. The evaporated refrigerant may be collected into the compressor 12.

In the water cooling mode, the refrigeration cycle circuit 2 may operate as follows. The first refrigerant, compressed by the compressor 12, may be condensed by the outdoor heat exchanger 18. The condensed refrigerant may be expanded by the expansion device 16. The expanded refrigerant may be evaporated by the first refrigerant and water heat exchanger 40. The evaporated refrigerant may be collected into the compressor 12.

The cascade circuit 4 and the refrigeration cycle circuit 2 both operate jointly using the first refrigerant and second refrigerant heat exchanger 50. The cascade circuit 4 includes the first refrigerant and second refrigerant heat exchanger 50, a cascade compressor 82, a second refrigerant and water heat exchanger 84, and a cascade expansion device 86.

The cascade compressor 82 may compress the second refrigerant that passes through the first refrigerant and second refrigerant heat exchanger 50. The cascade compressor 82 may be a constant-speed compressor or a variable capacity compressor. Alternatively, the cascade compressor 82 may include a plurality of constant-speed compressors connected in parallel to each other or a plurality of variable capacity compressors connected in parallel to each other. The cascade compressor 82 may also include a constant-speed compressor and a variable capacity compressor connected in parallel to each other. The cascade compressor 82 and the first refrigerant and second refrigerant heat exchanger 50 may be connected to each other via a cascade compressor inlet channel 88. The cascade compressor 82 and the second refrigerant and water heat exchanger 84 may be connected to each other via a cascade compressor outlet channel 90. The cascade compressor inlet channel 88 may be connected to the evaporation channel 54 (of the first refrigerant and second refrigerant heat exchanger 50). The cascade compressor outlet channel 90 may be connected to a heat discharge channel 94 (of the second refrigerant and water heat exchanger 84).

The second refrigerant and water heat exchanger 84 may perform a heat exchange between the second refrigerant compressed by the cascade compressor 82 and water. The second refrigerant and water heat exchanger 84 may function as a second water heating heat exchanger to secondarily heat water passing therethrough.

The second refrigerant and water heat exchanger 84 includes a heat absorption channel 92, through which water passes, and a heat discharge channel 94, in which the second refrigerant passing therethrough is heat exchanged with water. The second refrigerant and water heat exchanger 84 may be a plate type heat exchanger having heat absorption channel portions constituting the heat absorption channel 92 and heat discharge channel portions constituting the heat discharge channel 94 alternately arranged while heat transfer members are provided respectively between the heat absorption channel portions constituting the heat absorption channel 92 and the heat discharge channel portions constituting the heat discharge channel 94. Alternatively, the second refrigerant and water heat exchanger 84 may be a dual pipe heat exchanger configured so the heat absorption channel 92 or the heat discharge channel 94 surrounds the heat discharge channel 94 or the heat absorption channel 92. The second refrigerant and water heat exchanger 84 may be a shell and tube heat exchanger having a shell, through which the second refrigerant or water passes, and a plurality of tubes provided in the shell so the water or the second refrigerant passes through the tubes. The second refrigerant and water heat exchanger 84 and the cascade expansion device 86 may be connected to each other via a cascade expansion device connection channel 96.

The cascade expansion device 86 may expand the second refrigerant having passed through the second refrigerant and water heat exchanger 84. The cascade expansion device 86 may be a linear expansion valve (LEV) or an electronic expansion valve (EEV) in which an opening degree is variable. The cascade expansion device 86 and the first refrigerant and second refrigerant heat exchanger 50 may be connected to each other via an expansion device and heat exchanger connection channel 98. The expansion device and heat exchanger connection channel 98 may be connected to the evaporation channel 54 (of the first refrigerant and second refrigerant heat exchanger 50).

The second refrigerant, compressed by the cascade compressor 82, may be condensed in the heat discharge channel 94 of the second refrigerant and water heat exchanger 84. The condensed second refrigerant may be expanded by the cascade expansion device 86. The expanded second refrigerant may evaporate in the evaporation channel 54 (of the first refrigerant and second refrigerant heat exchanger 50). The evaporated second refrigerant may be collected into the cascade compressor 82.

The water heating channel 8 may be connected to the first refrigerant and water heat exchanger 40 and the second refrigerant and water heat exchanger 84 so water passes through the first refrigerant and water heat exchanger 40 and then through the second refrigerant and water heat exchanger 84.

The water heating channel 8 may be connected to the first refrigerant and water heat exchanger 40 and the second refrigerant and water heat exchanger 84 so water from a hot water supply tank 6 passes through the first refrigerant and water heat exchanger 40, passes through the second refrigerant and water heat exchanger 84, and is then collected into the hot water supply tank 6. The hot water supply tank 6 may be a water tank to store hot water to be supplied. A water supply unit 6A may introduce external water into the hot water supply tank 6. A water draining unit 6B may be connected to the hot water supply tank 6 and may drain water out of the hot water supply tank 6.

The water heating channel 8 may include a water introduction pipe 100 (or water introduction section) to introduce water into the first refrigerant and water heat exchanger 40, a heat exchanger connection pipe 102 (or heat exchanger connection section) to guide water having passed through the first refrigerant and water heat exchanger 40 to the second refrigerant and water heat exchanger 84, and a water discharge pipe 104 (or water discharge section) to discharge the water having passed through the second refrigerant and water heat exchanger 84. The water introduction pipe 100 and the water discharge pipe 104 may be connected to the hot water supply tank 6.

The water introduction pipe 100 may be connected between the hot water supply tank 6 and the heat absorption channel 42 (of the first refrigerant and water heat exchanger 40). The heat exchanger connection pipe 102 may be connected between the heat absorption channel 42 (of the first refrigerant and water heat exchanger 40) and the heat absorption channel 92 (of the second refrigerant and the water heat exchanger 84). The water discharge pipe 104 may be connected between the heat absorption channel 92 (of the second refrigerant and water heat exchanger 84) and the hot water supply tank 6. In the above connection structure, the water introduction pipe 100 and the heat exchanger connection pipe 102 are connected to the heat absorption channel 42 (of the first refrigerant and water heat exchanger 40) so water passes through the heat absorption channel 42 (of the first refrigerant and water heat exchanger 40). The heat exchanger connection pipe 102 and the water discharge pipe 104 are connected to the heat absorption channel 92 (of the second refrigerant and water heat exchanger 84) so water passes through the heat absorption channel 92 (of the second refrigerant and water heat exchanger 84).

A water pump 106 may be mounted (or provided) on the water heating channel 8. The water pump 106 may pump water from the hot water supply tank 6 so the water passes through the heat absorption channel 42 (of the first refrigerant and water heat exchanger 40), passes through the heat absorption channel 92 (of the second refrigerant and water heat exchanger 84), and is then collected into the hot water supply tank 6. The water pump 106 is mounted (or provided) so water from the hot water supply tank 6 flows into the water introduction pipe 100 and then the water is collected into the hot water supply tank 6 through the water discharge pipe 104.

The water heating channel 8 is connected to the heat absorption channel 42 (of the first refrigerant and water heat exchanger 40) and the heat absorption channel 92 (of the second refrigerant and water heat exchanger 84) so water from the hot water supply tank 6 is primarily heated in the heat absorption channel 42 (of the first refrigerant and water heat exchanger 40), is secondarily heated in the heat absorption channel 92 (of the second refrigerant and water heat exchanger 84), and is then collected into the hot water supply tank 6.

Both the refrigeration cycle circuit 2 and the cascade circuit 4 may operate based on a temperature of the water heating channel 8, or the refrigeration cycle circuit 2 alone (without the cascade circuit 4) may operate based on the temperature of the water heating channel 8. The refrigeration cycle circuit 2 may continuously operate when a water heating load or a water cooling load exists. The cascade circuit 4 may selectively operate based on the temperature of the water heating channel 8. When the refrigeration cycle circuit 2 stops, the cascade circuit 4 also stops.

When the mode switching valve 20 operates to select the water heating mode, both the compressor 12 and the cascade compressor 82 may be driven or the compressor 12 alone may be driven (without the cascade compressor 82 being driven).

When the mode switching valve 20 operates to select the water cooling mode, the compressor 12 is driven while the cascade compressor 82 is stopped.

In the water heating mode, the heat pump type water heating apparatus may operate as follows. The water pump 106 may be driven, and the outdoor fan 19 rotates. The mode switching valve 20 may be controlled so the first refrigerant compressed by the compressor 12 is supplied to the dual heat exchanger 14. The compressor 12 is driven, and the cascade compressor 82 is selectively driven.

In the water cooling mode, the heat pump type water heating apparatus may operate as follows. The water pump 106 may be driven, and the outdoor fan 19 rotates. The mode switching valve 20 may be controlled so the first refrigerant compressed by the compressor 12 is supplied to the outdoor heat exchanger 18. The compressor 12 is driven, and the cascade compressor 82 is stopped.

In the heat pump type water heating apparatus, the water heating mode may include a single heating mode, a reheating mode, and a multistage heating mode.

The single heating mode may be described with reference to FIG. 2.

The single heating mode is a mode in which heat only from the first refrigerant is transmitted to water. In the single heating mode, the compressor 12 is driven, and the cascade compressor 82 is stopped. Additionally, the first control valve 68 is opened, and the second control valve 78 is closed.

In the single heating mode, the first refrigerant and water heat exchanger 40 is heated by the first refrigerant, and water from the hot water supply tank 6 is heated by the first refrigerant and water heat exchanger 40 while passing through the first refrigerant and water heat exchanger 40.

When the compressor 12 is driven, the first refrigerant compressed by the compressor 12 passes through the mode switching valve 20 and a heat exchange is performed with water in the heat discharge channel 44 (of the first refrigerant and water heat exchanger 40) with a result that the first refrigerant is condensed. Subsequently, the condensed first refrigerant is expanded by the first control valve 68 and/or the expansion device 16 while passing through the first control valve 68 and the expansion device 16. The expanded first refrigerant may be heat exchanged with outdoor air in the outdoor heat exchanger 18 with a result that the first refrigerant is evaporated. The evaporated first refrigerant may be collected in the compressor 12.

At this time, water from the hot water supply tank 6 passes through the first refrigerant and water heat exchanger 40 and then through the second refrigerant and water heat exchanger 84. While the water passes through the heat absorption channel 42 (of the first refrigerant and water heat exchanger 40), heat from the first refrigerant is transmitted to the water with a result that the water is heated. The heated water is collected into the hot water supply tank 6 with a result that a temperature of the water in the hot water supply tank 6 increases.

The reheating mode may be described with reference to FIG. 3.

The reheating mode is a mode in which heat from the first refrigerant is transmitted to the second refrigerant, and heat from the second refrigerant is transmitted to water. In the reheating mode, the compressor 12 and the cascade compressor 82 are driven. Additionally, the first control valve 68 is closed, and the second control valve 78 is opened.

In the reheating mode, the first refrigerant and second refrigerant heat exchanger 50 is heated by the first refrigerant, the second refrigerant and water heat exchanger 84 is heated by the second refrigerant, and water from the hot water supply tank 6 is heated by the second refrigerant and water heat exchanger 84 while passing through the second refrigerant and water heat exchanger 84.

When the compressor 12 and the cascade compressor 82 are driven, the first refrigerant compressed by the compressor 12 passes through the mode switching valve 20 and is heat exchanged with the second refrigerant in the condensation channel 52 (of the first refrigerant and second refrigerant heat exchanger 50) with a result that the first refrigerant is condensed. Subsequently, the condensed first refrigerant is expanded by the second control valve 78 and/or the expansion device 16 while passing through the second control valve 78 and the expansion device 16. The expanded first refrigerant is heat exchanged with outdoor air in the outdoor heat exchanger 18 with a result that the first refrigerant is evaporated. The evaporated first refrigerant may be collected into the compressor 12.

On the other hand, the second refrigerant compressed by the cascade compressor 82 is heat exchanged with water in the heat discharge channel 94 (of the second refrigerant and water heat exchanger 84) with a result that the second refrigerant is condensed. Subsequently, the condensed second refrigerant is expanded by the cascade expansion device 86. The expanded second refrigerant is heat exchanged with the first refrigerant in the evaporation channel 54 (of the first refrigerant and second refrigerant heat exchanger 50) with a result that the second refrigerant is evaporated. The evaporated second refrigerant is collected into the cascade compressor 82.

At this time, water from the hot water supply tank 6 passes through the first refrigerant and water heat exchanger 40 and then through the second refrigerant and water heat exchanger 84. While the water passes through the heat absorption channel 92 (of the second refrigerant and water heat exchanger 84), heat from the second refrigerant is transmitted to the water with a result that the water is heated. The heated water is collected into the hot water supply tank 6 with a result that a temperature of the water in the hot water supply tank 6 increases.

The multistage heating mode may be described with reference to FIG. 4.

The multistage heating mode is a mode in which heat from the first refrigerant is transmitted to water and the second refrigerant, and heat from the second refrigerant is transmitted to water. In the multistage heating mode, the compressor 12 and the cascade compressor 82 are driven. Additionally, the first control valve 68 and the second control valve 78 are opened.

In the multistage heating mode, the first refrigerant and water heat exchanger 40 is heated by the first refrigerant, the second refrigerant and water heat exchanger 84 is heated by the second refrigerant, and water from the hot water supply tank 6 is primarily heated by the first refrigerant and water heat exchanger 40 while passing through the first refrigerant and water heat exchanger 40. The water may be secondarily heated by the second refrigerant and water heat exchanger 84 while passing through the second refrigerant and water heat exchanger 84.

When the compressor 12 and the cascade compressor 82 are driven, the first refrigerant compressed by the compressor 12 passes through the mode switching valve 20 and is distributed to the first refrigerant and water heat exchanger 40 and to the first refrigerant and second refrigerant heat exchanger 50.

The first refrigerant distributed to the first refrigerant and water heat exchanger 40 is heat exchanged with water in the heat discharge channel 44 (of the first refrigerant and water heat exchanger 40) with a result that the first refrigerant is condensed. Subsequently, the condensed first refrigerant passes through the first control valve 68 and flows to the expansion device 16. On the other hand, the first refrigerant distributed to the first refrigerant and second refrigerant heat exchanger 50 is heat exchanged with the second refrigerant in the condensation channel 52 (of the first refrigerant and second refrigerant heat exchanger 50) with a result that the first refrigerant is condensed. Subsequently, the condensed first refrigerant passes through the second control valve 78 and is mixed (or combined) with the first refrigerant having passed through the first control valve 68. The mixture flows to the expansion device 16.

The first refrigerant condensed by the first refrigerant and water heat exchanger 40 is expanded by the first control valve 68 and/or the expansion device 16, and the first refrigerant condensed by the first refrigerant and second refrigerant heat exchanger 50 is expanded by the second control valve 78 and/or the expansion device 16. The first refrigerant flows to the outdoor heat exchanger 18. The first refrigerant is heat exchanged with outdoor air in the outdoor heat exchanger 18 with a result that the first refrigerant is evaporated. The evaporated first refrigerant is collected into the compressor 12.

On the other hand, the second refrigerant compressed by the cascade compressor 82 is heat exchanged with water in the heat discharge channel 94 (of the second refrigerant and water heat exchanger 84) with a result that the second refrigerant is condensed. Subsequently, the condensed second refrigerant is expanded by the cascade expansion device 86. The expanded second refrigerant is heat exchanged with the first refrigerant in the evaporation channel 54 (of the first refrigerant and second refrigerant heat exchanger 50) with a result that the second refrigerant is evaporated. The evaporated second refrigerant is collected into the cascade compressor 82.

At this time, water from the hot water supply tank 6 passes through the first refrigerant and water heat exchanger 40 and then through the second refrigerant and water heat exchanger 84. While the water passes through the heat absorption channel 42 (of the first refrigerant and water heat exchanger 40), heat from the first refrigerant is primarily transmitted to the water with a result that the water is heated. On the other hand, while the water passes through the heat absorption channel 92 (of the second refrigerant and water heat exchanger 84), heat from the second refrigerant is secondarily transmitted to the water with a result that the water is heated. The heated water is collected into the hot water supply tank 6 with a result that that a temperature of the water in the hot water supply tank 6 increases.

The water cooling mode may be described with reference to FIG. 5.

The water cooling mode is a mode in which water in the hot water supply tank 6 is cooled by the first refrigerant.

In the water cooling mode, the compressor 12 is driven, and the cascade compressor 82 is stopped. Additionally, the first control valve 68 is opened, and the second control valve 78 is closed.

In the water cooling mode, the first refrigerant and water heat exchanger 40 is cooled by the first refrigerant, and water from the hot water supply tank 6 is cooled by the first refrigerant and water heat exchanger 40 while passing through the first refrigerant and water heat exchanger 40.

When the compressor 12 is driven, the first refrigerant compressed by the compressor 12 passes through the mode switching valve 20 and flows to the outdoor heat exchanger 18. The first refrigerant is condensed by the outdoor heat exchanger 18. Subsequently, the condensed first refrigerant is expanded by the expansion device 16 and/or the first control valve 68 while passing through the expansion device 16 and the first control valve 68. The expanded first refrigerant is heat exchanged with water in the heat discharge channel 44 (of the first refrigerant and water heat exchanger 40) with a result that the first refrigerant is evaporated. The evaporated first refrigerant is collected into the compressor 12.

At this time, water from the hot water supply tank 6 passes through the first refrigerant and water heat exchanger 40 and then through the second refrigerant and water heat exchanger 84. While the water passes through the heat absorption channel 42 (of the first refrigerant and water heat exchanger 40), heat from the water is transmitted to the first refrigerant with a result that the water is cooled. The cooled water is collected into the hot water supply tank 6 with a result that the temperature of the water in the hot water supply tank 6 decreases.

In the heat pump type water heating apparatus, the components of the refrigeration cycle circuit 2 and the components of the cascade circuit 4 may be provided in a single unit. Alternatively, the components of the refrigeration cycle circuit 2 and the components of the cascade circuit 4 may be provided separately in an outdoor unit O and a water heating unit H.

In the heat pump type water heating apparatus, the compressor 2, the expansion device 16, the outdoor heat exchanger 18, the outdoor fan 18, and the mode switching valve 20 of the refrigeration cycle circuit 2 may be provided in the outdoor unit O, and the dual heat exchanger 14 and the first and second control valves 68 and 78 of the refrigeration cycle circuit 2 and the cascade circuit 4 may be provided in the water heating unit H.

The heat pump type water heating apparatus may further include an outdoor temperature sensor 110 to sense an outdoor temperature and a water temperature sensor 112 to sense a temperature of water introduced into the first refrigerant and water heat exchanger 40 or a temperature of water discharged from the second refrigerant and water heat exchanger 84.

The heat pump type water heating apparatus may further include an input unit to allow a user to input a desired water heating temperature and a controller (not shown) to control the heat pump type water heating apparatus to operate in the single heating mode, the reheating mode or the multistage heating mode based on the outdoor temperature sensed by the outdoor temperature sensor 110, the water temperature sensed by the water temperature sensor 112, and the desired water heating temperature input through the input unit when the heat pump type water heating apparatus operates in the water heating mode.

Figure 6:
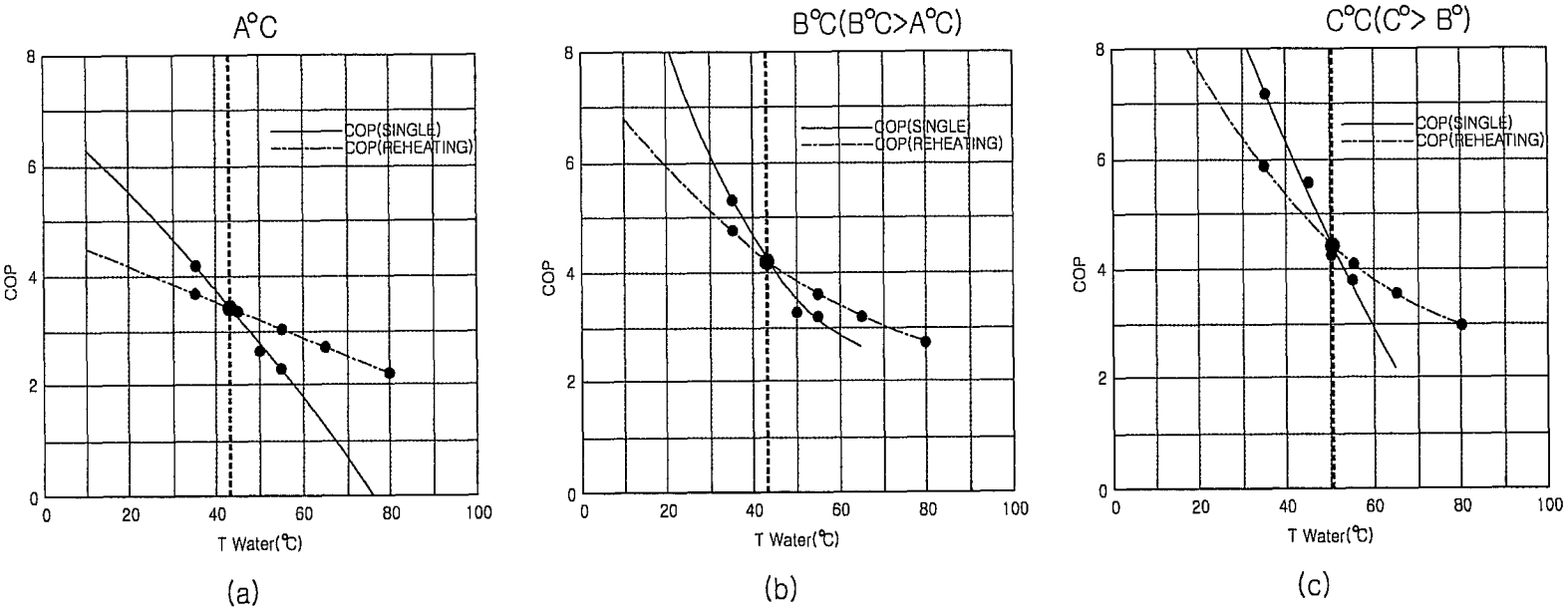
FIG. 6 is a graph illustrating optimum efficiency points based on outdoor temperatures and water temperature of a heat pump type water heating apparatus according to an embodiment of the present invention.
Figure 7:
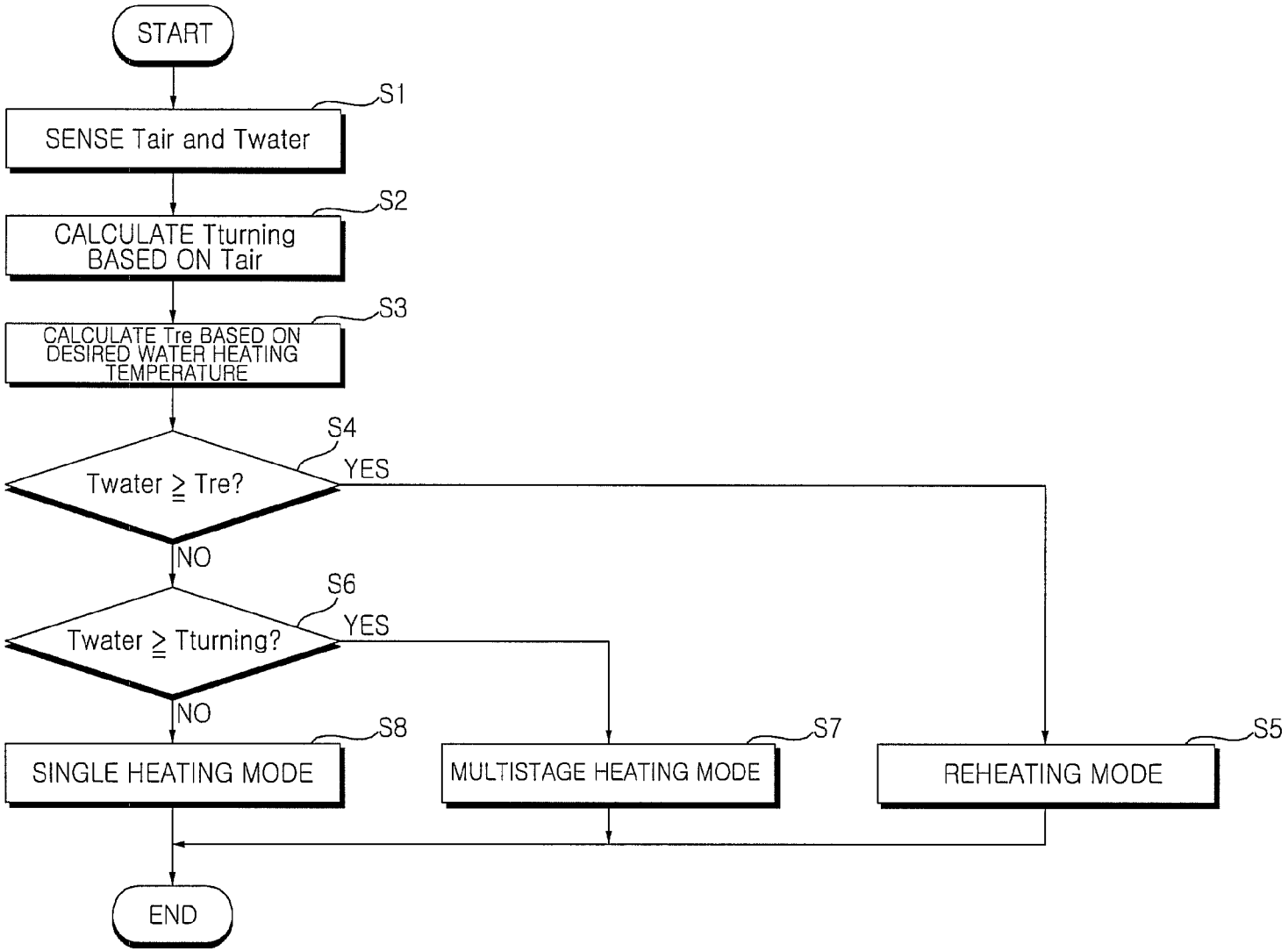
FIG. 7 is a flow chart of a control method of a heat pump type water heating apparatus according to an embodiment of the present invention.

FIG. 6 is a graph illustrating optimum efficiency points based on outdoor temperatures and water temperature of a heat pump type water heating apparatus according to an embodiment of the present invention. FIG. 7 is a flow chart of a control method of a heat pump type water heating apparatus according to an embodiment of the present invention. Other embodiments and configurations may also be provided.

In the water heating mode of the heat pump type water heating apparatus, optimum efficiency points may be different depending upon different outdoor temperatures Tair (A ° C., B ° C. and C ° C.) and water temperature Twater, as shown in FIGS. 6(*a*), 6(*b*) and 6(*c*). The optimum efficiency points may be controlled based on the outdoor temperatures Tair (A ° C., B ° C. and C ° C.) and the water temperature Twater.

When the desired water heating temperature is low, the heat pump type water heating apparatus may operate in the single heating mode. When the desired water heating temperature is high and the current water temperature is high, the heat pump type water heating apparatus may operate in the reheating mode. When the desired water heating temperature is high and the current water temperature is low, the heat pump type water heating apparatus may operate in the multistage heating mode.

In the heat pump type water heating apparatus, the multistage heating setting temperature Tturning to determine whether the heat pump type water heating apparatus is to operate in the multistage heating mode based on a sensed outdoor temperature Tair may be calculated using a mathematical expression(s) or a table. Additionally, the reheating setting temperature Tre to determine whether the heat pump type water heating apparatus is to operate in the reheating mode based on a desired water heating temperature input through the input unit may be calculated. The mode switching between the single heating mode, the reheating mode and the multistage heating mode may be performed based on a comparison of water temperature with the multistage heating setting temperature Tturning and the reheating setting temperature Tre.

The control method of the heat pump type water heating apparatus may include a sensing operation of the outdoor temperature sensor 110 sensing the outdoor temperature Tair and the water temperature sensor 112 sensing water temperature Twater in the water heating mode (S1).

The control method may further include a multistage heating setting temperature calculating operation of calculating multistage heating setting temperature Tturning based on the outdoor temperature sensed by the outdoor temperature sensor 110 (S2).

The control method may further include a reheating setting temperature calculating operation of calculating the reheating setting temperature Tre based on the desired water heating temperature input through the input unit (S3).

The control method may further include a reheating mode operating operation of operating the heat pump type water heating apparatus in the reheating mode (as shown in FIG. 3) when the water temperature Twater sensed by the water temperature sensor 112 is equal to or greater than the reheating setting temperature Tre (S4 and S5).

The control method may further include a multistage heating mode operating operation of operating the heat pump type water heating apparatus in the multistage heating mode (as shown in FIG. 4) when the water temperature Twater sensed by the water temperature sensor 112 is less than the reheating setting temperature Tre and is equal to or greater than the multistage heating setting temperature Tturning (S6 and S7).

The control method may further include a single heating mode operating operation of operating the heat pump type water heating apparatus in the single heating mode (as shown in FIG. 2) when the water temperature Twater sensed by the water temperature sensor 112 is less than the multistage heating setting temperature Tturning (S6 and S8).

The heat pump type water heating apparatus according to an example embodiment may have the following effects.

Water may be primarily heated by the first refrigerant and water heat exchanger, which has been heated by the first refrigerant, and may be secondarily heated by the second refrigerant and water heat exchanger, which has been heated by the first refrigerant and the second refrigerant. Consequently, the heat pump type water heating apparatus may have the effect of achieving efficient water heating and rapidly increasing water temperature even when the water temperature is low.

The single heating mode, the reheating mode or the multistage heating mode may be selected based on water temperature or desired water heating temperature. Consequently, the heat pump type water heating apparatus may have the effect of improving water heating efficiency while minimizing power consumption.

The heat pump type water heating apparatus may have the effect of selecting the optimum mode based on outdoor temperature and water temperature.

The heat pump type water heating apparatus may have the effect of cooling water in the hot water supply tank according to the water cooling mode of the refrigeration cycle circuit.

Embodiments of the present invention may have been made in view of problems discussed above, and embodiments may provide a heat pump type water heating apparatus that heats water using a first refrigerant and a second refrigerant in multi stages so as to improve efficiency and that is optimally operated while minimizing power consumption.

A heat pump type water heating apparatus may include a refrigeration cycle circuit having a first refrigerant and water heat exchanger to perform a heat exchange between a first refrigerant and water, and a first refrigerant and second refrigerant heat exchanger to perform a heat exchange between the first refrigerant and a second refrigerant. The heat pump type water heating apparatus may further include a cascade circuit having the first refrigerant and second refrigerant heat exchanger operate jointly with the refrigeration cycle circuit, the cascade circuit also having a second refrigerant and water heat exchanger to perform a heat exchange between the second refrigerant and water. The heat pump type water heating apparatus may also include a water heating channel connected to the first refrigerant and water heat exchanger and the second refrigerant and water heat exchanger so that water passes through the first refrigerant and water heat exchanger and then through the second refrigerant and water heat exchanger. Both the refrigeration cycle circuit and the cascade circuit or the refrigeration cycle circuit alone may operate depending upon the temperature of the water heating channel.

The first refrigerant and water heat exchanger and the first refrigerant and second refrigerant heat exchanger may be arranged so that refrigerant flow channels are connected in parallel to each other.

The water heating channel may include a water introduction pipe, through which water is introduced into the first refrigerant and water heat exchanger, a heat exchanger connection pipe, through which the water having passed through the first refrigerant and water heat exchanger is guided to the second refrigerant and water heat exchanger, and a water discharge pipe, through which the water having passed the second refrigerant and water heat exchanger is discharged.

The heat pump type water heating apparatus may operate in one mode selected from a group consisting of: a single heating mode in which a compressor is driven, a cascade compressor is stopped, and the first refrigerant flows to the first refrigerant and water heat exchanger, a reheating mode in which the compressor and the cascade compressor are driven, and the first refrigerant flows to the first refrigerant and second refrigerant heat exchanger, and a multistage heating mode in which the compressor and the cascade compressor are driven, and the first refrigerant flows to the first refrigerant and water heat exchanger and to the first refrigerant and second refrigerant heat exchanger.

The heat pump type water heating apparatus may operate in the reheating mode when a water temperature sensed by a water temperature sensor is equal to or greater than reheating setting temperature, the heat pump type water heating apparatus may operate in the multistage heating mode when the water temperature sensed by the water temperature sensor is less than the reheating setting temperature and is equal to or greater than multistage heating setting temperature, and the heat pump type water heating apparatus may operate in the single heating mode when the water temperature sensed by the water temperature sensor is less than the multistage heating setting temperature.

The cascade circuit may stop when the refrigeration cycle circuit is stopped.

A heat pump type water heating apparatus may include a refrigeration cycle circuit including a compressor, a dual heat exchanger, an expansion device, and an outdoor heat exchanger, via which a first refrigerant is circulated, the dual heat exchanger including a first refrigerant and water heat exchanger to perform a heat exchange between the first refrigerant and water and a first refrigerant and second refrigerant heat exchanger to perform a heat exchange between the first refrigerant and a second refrigerant. The heat pump type water heating apparatus may include a cascade compressor to compress the second refrigerant having passed through the first refrigerant and second refrigerant heat exchanger, a second refrigerant and water heat exchanger to perform a heat exchange between the second refrigerant compressed by the cascade compressor and water, a cascade expansion device to expand the second refrigerant having passed through the second refrigerant and water heat exchanger, and a water heating channel connected to the first refrigerant and water heat exchanger and the second refrigerant and water heat exchanger so that water passes through the first refrigerant and water heat exchanger and then through the second refrigerant and water heat exchanger.

The first refrigerant and water heat exchanger and the first refrigerant and second refrigerant heat exchanger may be arranged so that refrigerant flow channels are connected in parallel to each other.

The water heating channel may include a water introduction pipe, through which water is introduced into the first refrigerant and water heat exchanger, a heat exchanger connection pipe, through which the water having passed through the first refrigerant and water heat exchanger is guided to the second refrigerant and water heat exchanger, and a water discharge pipe, through which the water having passed the second refrigerant and water heat exchanger is discharged.

The first refrigerant and water heat exchanger may include a heat absorption channel, to which the water introduction pipe and the heat exchanger connection pipe are connected so that water passes through the heat absorption channel, and a heat discharge channel, in which the first refrigerant passing therethrough is heat exchanged with water, and the second refrigerant and water heat exchanger may include a heat absorption channel, to which the heat exchanger connection pipe and the water discharge pipe are connected so that water passes through the heat absorption channel, and a heat discharge channel, in which the second refrigerant passing therethrough is heat exchanged with water.

The water introduction pipe and the water discharge pipe may be connected to a hot water supply tank.

The heat pump type water heating apparatus may operate in one mode selected from a group consisting of: a single heating mode in which the compressor is driven, the cascade compressor is stopped, and the first refrigerant flows to the first refrigerant and water heat exchanger, a reheating mode in which the compressor and the cascade compressor are driven, and the first refrigerant flows to the first refrigerant and second refrigerant heat exchanger, and a multistage heating mode in which the compressor and the cascade compressor are driven, and the first refrigerant flows to the first refrigerant and water heat exchanger and to the first refrigerant and second refrigerant heat exchanger.

The heat pump type water heating apparatus may operate in the single heating mode when a desired water heating temperature is low, the heat pump type water heating apparatus may operate in the reheating mode when a desired water heating temperature is high and a current water temperature is high, and the heat pump type water heating apparatus may operate in the multistage heating mode when the desired water heating temperature is high and the current water temperature is low.

The heat pump type water heating apparatus may further include a first control valve to control the flow of the first refrigerant to the first refrigerant and water heat exchanger and a second control valve to control the flow of the first refrigerant to the first refrigerant and second refrigerant heat exchanger.

The first control valve may be opened and the second control valve may be closed in the single heating mode, the first control valve may be closed and the second control valve may be opened in the reheating mode, and the first control valve and the second control valve may be opened in the multistage heating mode.

The heat pump type water heating apparatus may further include a three way valve to control the flow of the first refrigerant to the first refrigerant and water heat exchanger and to the first refrigerant and second refrigerant heat exchanger.

The heat pump type water heating apparatus may further include an outdoor temperature sensor to sense an outdoor temperature, a water temperature sensor to sense a water temperature, an input unit to allow a desired water heating temperature to be input, and a controller to control the heat pump type water heating apparatus to operate in the single heating mode, the reheating mode or the multistage heating mode based on the outdoor temperature sensed by the outdoor temperature sensor, the water temperature sensed by the water temperature sensor, and the desired water heating temperature input through the input unit.

The heat pump type water heating apparatus may operate in the reheating mode when the water temperature sensed by the water temperature sensor is equal to or greater than reheating setting temperature, the heat pump type water heating apparatus may operate in the multistage heating mode when the water temperature sensed by the water temperature sensor is less than the reheating setting temperature and is equal to or greater than multistage heating setting temperature, and the heat pump type water heating apparatus may operate in the single heating mode when the water temperature sensed by the water temperature sensor is lower than the multistage heating setting temperature.

The heat pump type water heating apparatus may further include a mode switching valve to perform switching between a water heating mode and a water cooling mode so that the refrigeration cycle circuit operates in the water heating mode or the water cooling mode.

Both the compressor and the cascade compressor, or the compressor alone, may be driven in the water heating mode.

The compressor may be driven and the cascade compressor may be stopped in the water cooling mode.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat pump type water heating apparatus comprising:

a refrigeration cycle circuit having a first refrigerant and water heat exchanger to perform a heat exchange between a first refrigerant and water, and a first refrigerant and second refrigerant heat exchanger to perform a heat exchange between the first refrigerant and a second refrigerant, wherein the first refrigerant and water heat exchanger and the first refrigerant and second refrigerant heat exchanger are connected in parallel to each other;

a cascade circuit having the first refrigerant and second refrigerant heat exchanger and a second refrigerant and water heat exchanger to perform a heat exchange between the second refrigerant and water, the first refrigerant and second refrigerant heat exchanger to operate jointly with the refrigeration cycle circuit and the cascade circuit;

a water heating channel connected to the first refrigerant and water heat exchanger and the second refrigerant and water heat exchanger so water passes through the first refrigerant and water heat exchanger and then through the second refrigerant and water heat exchanger;

a first control valve to control flow of the first refrigerant to the first refrigerant and water heat exchanger; and a second control valve to control flow of the first refrigerant to the first refrigerant and second refrigerant heat exchanger, wherein both the refrigeration cycle circuit and the cascade circuit operate based on a temperature of the water heating channel or the refrigeration cycle circuit operates alone without the cascade circuit based on a temperature of the water heating channel, wherein the heat pump type water heating apparatus operates in a mode selected from a group consisting of:

a single heating mode in which a compressor is driven, a cascade compressor is stopped, the first control valve is opened, the second control valve is closed, and the first refrigerant flows to the first refrigerant and water heat exchanger;

a reheating mode in which the compressor and the cascade compressor are driven, the first control valve is closed, the second control valve is opened and the first refrigerant flows to the first refrigerant and second refrigerant heat exchanger; and a multistage heating mode in which the compressor and the cascade compressor are driven, the first control valve is opened, the second control valve is opened, and the first refrigerant flows to the first refrigerant and water heat exchanger and to the first refrigerant and second refrigerant heat exchanger.

2. The heat pump type water heating apparatus according to claim 1, wherein the water heating channel comprises:

a water introduction section to provide water to the first refrigerant and water heat exchanger;

a heat exchanger connection section to guide the water that passed through the first refrigerant and water heat exchanger to the second refrigerant and water heat exchanger; and a water discharge section to discharge the water that passed the second refrigerant and water heat exchanger.

3. The heat pump type water heating apparatus according to claim 1, wherein the heat pump type water heating apparatus operates in the reheating mode when a water temperature sensed by a water temperature sensor is equal to or greater than a reheating setting temperature, the heat pump type water heating apparatus operates in the multistage heating mode when the water temperature sensed by the water temperature sensor is less than the reheating setting temperature and is equal to or greater than a multistage heating setting temperature, and the heat pump type water heating apparatus operates in the single heating mode when the water temperature sensed by the water temperature sensor is less than the multistage heating setting temperature.

4. The heat pump type water heating apparatus according to claim 1, further comprising a mode switching valve to switch between a water heating mode and a water cooling mode so the refrigeration cycle circuit operates in the water heating mode or the water cooling mode.

5. A heat pump type water heating apparatus comprising:

a refrigeration cycle circuit that includes a compressor, a dual heat exchanger, an expansion device, and an outdoor heat exchanger, the refrigeration cycle circuit to circulate a first refrigerant, the dual heat exchanger including a first refrigerant and water heat exchanger to perform a heat exchange between the first refrigerant and water, and a first refrigerant and second refrigerant heat exchanger to perform a heat exchange between the first refrigerant and a second refrigerant, wherein the first refrigerant and water heat exchanger and the first refrigerant and second refrigerant heat exchanger are connected in parallel to each other;

a cascade compressor to compress the second refrigerant that passes through the first refrigerant and second refrigerant heat exchanger;

a second refrigerant and water heat exchanger to perform a heat exchange between the second refrigerant compressed by the cascade compressor and water;

a cascade expansion device to expand the second refrigerant that passes through the second refrigerant and water heat exchanger;

a water heating channel connected to the first refrigerant and water heat exchanger and the second refrigerant and water heat exchanger so water passes through the first refrigerant and water heat exchanger and then through the second refrigerant and water heat exchanger;

a first control valve to control flow of the first refrigerant to the first refrigerant and water heat exchanger; and a second control valve to control flow of the first refrigerant to the first refrigerant and second refrigerant heat exchanger, wherein the heat pump type water heating apparatus operates in a mode selected from a group consisting of:

a single heating mode in which the compressor is driven, the cascade compressor is stopped, the first control valve is opened, the second control valve is closed, and the first refrigerant flows to the first refrigerant and water heat exchanger;

a reheating mode in which the compressor and the cascade compressor are driven, the first control valve is closed, the second control valve is opened, and the first refrigerant flows to the first refrigerant and second refrigerant heat exchanger; and a multistage heating mode in which the compressor and the cascade compressor are driven, the first control valve is opened, the second control valve is opened, and the first refrigerant flows to the first refrigerant and water heat exchanger and to the first refrigerant and second refrigerant heat exchanger.

6. The heat pump type water heating apparatus according to claim 5, wherein the water heating channel comprises:

a water introduction section to provide water to the first refrigerant and water heat exchanger;

a heat exchanger connection section to guide the water that passes through the first refrigerant and water heat exchanger to the second refrigerant and water heat exchanger; and a water discharge section to discharge the water that passes the second refrigerant and water heat exchanger.

7. The heat pump type water heating apparatus according to claim 6, wherein the first refrigerant and water heat exchanger includes a heat absorption channel connected to the water introduction section and the heat exchanger connection section so water passes through the heat absorption channel, and a heat discharge channel to receive the first refrigerant and provide a heat exchange with water, and the second refrigerant and water heat exchanger includes a heat absorption channel connected to the heat exchanger connection section and the water discharge section so water passes through the heat absorption channel, and a heat discharge channel to receive the second refrigerant and provide a heat exchange with water.

8. The heat pump type water heating apparatus according to claim 7, further comprising a hot water supply tank connected to the water introduction section and the water discharge section.

9. The heat pump type water heating apparatus according to claim 5, further comprising:

an outdoor temperature sensor to sense an outdoor temperature;

a water temperature sensor to sense a water temperature;

an input unit to input a desired water heating temperature; and a controller to control the heat pump type water heating apparatus to operate in the single heating mode, the reheating mode or the multistage heating mode based on the outdoor temperature sensed by the outdoor temperature sensor, the water temperature sensed by the water temperature sensor, or the desired water heating temperature input through the input unit.

10. The heat pump type water heating apparatus according to claim 9, wherein the heat pump type water heating apparatus operates in the reheating mode when the water temperature sensed by the water temperature sensor is equal to or greater than a reheating setting temperature, the heat pump type water heating apparatus operates in the multistage heating mode when the water temperature sensed by the water temperature sensor is less than the reheating setting temperature and is equal to or greater than a multistage heating setting temperature, and the heat pump type water heating apparatus operates in the single heating mode when the water temperature sensed by the water temperature sensor is less than the multistage heating setting temperature.

11. The heat pump type water heating apparatus according to claim 5, further comprising a mode switching valve to switch between a water heating mode and a water cooling mode so the refrigeration cycle circuit operates in the water heating mode or the water cooling mode.

12. The heat pump type water heating apparatus according to claim 11, wherein both the compressor and the cascade compressor are driven in the water heating mode or the compressor is driven alone without the cascade compressor in the water heating mode.

13. The heat pump type water heating apparatus according to claim 11, wherein the compressor is driven in the water cooling mode and the cascade compressor is stopped in the water cooling mode.

* * * * *